US010294615B2

(12) United States Patent
Lombardini

(10) Patent No.: US 10,294,615 B2
(45) Date of Patent: May 21, 2019

(54) RUBBER PAD FOR RAILS

(71) Applicant: PLASTEX SA, Madonna del Piano (CH)

(72) Inventor: Marco Lombardini, Vernate (CH)

(73) Assignee: PLASTEX SA, Madonna del Piano (CH)

( * ) Notice: Subject to any disclaimer, the term of this patent is extended or adjusted under 35 U.S.C. 154(b) by 99 days.

(21) Appl. No.: 15/129,398

(22) PCT Filed: Mar. 26, 2015

(86) PCT No.: PCT/IB2015/052250
§ 371 (c)(1),
(2) Date: Sep. 26, 2016

(87) PCT Pub. No.: WO2015/155623
PCT Pub. Date: Oct. 15, 2015

(65) Prior Publication Data

US 2017/0107672 A1 Apr. 20, 2017

(30) Foreign Application Priority Data

Apr. 9, 2014 (CH) ..... 549/14

(51) Int. Cl.
*E01B 9/68* (2006.01)

(52) U.S. Cl.
CPC ..... *E01B 9/688* (2013.01); *E01B 9/681* (2013.01); *E01B 9/683* (2013.01); *E01B 9/686* (2013.01)

(58) Field of Classification Search
CPC ..... E01B 9/681; E01B 9/683; E01B 9/686; E01B 9/688; E01B 9/68; E01B 9/685
USPC ..... 238/283, 382
See application file for complete search history.

(56) References Cited

U.S. PATENT DOCUMENTS 1,897,500 A * 2/1933 Shives ..... E01B 9/32 238/283
2,057,955 A * 10/1936 Kahn ..... E01B 9/683 238/283
2,291,611 A 8/1942 Dooling
2,609,991 A * 9/1952 Jones ..... E01B 9/685 238/283
2,713,974 A * 7/1955 Lofton ..... E01B 9/36 238/283
3,827,631 A * 8/1974 Kirik ..... E01B 9/686 238/283
7,080,791 B2 7/2006 Geissele et al.

FOREIGN PATENT DOCUMENTS

AT 387249 12/1988
CA 2361745 * 1/2002
EP 1809810 2/2010
(Continued)

OTHER PUBLICATIONS

International Search Report and Written Opinion from International Application No. PCT/IB2015/052250 dated Oct. 13, 2015.

*Primary Examiner* — Mark T Le
(74) *Attorney, Agent, or Firm* — Dorsey & Whitney LLP

(57) ABSTRACT

A rubber pad is configured to be arranged between a sleeper of a track and a rail of the track. The pad has a flat portion with a width substantially the same as a width of the sleeper; the flat portion comprises a plurality of holes.

14 Claims, 6 Drawing Sheets

(56) References Cited

FOREIGN PATENT DOCUMENTS

| | | |
|---|---|---|
| GB | 851796 | 10/1960 |
| JP | H0814325 | 1/1996 |
| WO | WO 94/25675 | * 11/1994 |

* cited by examiner

RUBBER PAD FOR RAILS

FIELD OF APPLICATION

The present invention relates to a rubber pad intended to be arranged between a sleeper of a track and a rail of the track. In particular, the invention relates to a pad of the abovementioned type, having a portion with a width substantially the same as the width of the sleeper.

PRIOR ART

Pads made of rubber, and in particular vulcanized rubber, intended to be arranged between a sleeper of a track, for example a sleeper made of cement or wood, and a rail of the track, are known. The rail is arranged at a distance from the ground and positioned on top of a plurality of sleepers, which are arranged parallel to each other along the track, the rubber pad being arranged in between said rail and the sleeper.

The pad has the function of facilitating laying in position of the rail. In particular, the known pads comprise longitudinal strips, which are formed in the thickness of the pad, along the entire pad, in the direction of the rail, and are intended to face the rail in order to reduce friction between the rail and the rubber pad, during laying, thus allowing small movements of the rail to help it find its correct position on the sleepers. Even a small reduction in the friction may facilitate positioning; in this connection, it should be remembered that the rail may be several tens of meters in length and weigh from 36 to 60 kg per meter.

The pads are also used because they improve both the static and the dynamic mechanical coupling between the sleeper and the rail, improving seating of the rail on the sleeper when no rolling stock is on the track (static coupling) or better distributing the weight of the train on the sleeper when it passes along the track (dynamic coupling). The known pads have, however, a number of drawbacks, specially due to the fact that they do not perform an effective damping action between the sleeper and the track, when a train pass, or at least they are prone to a significant deterioration in performance over time. In this connection, after the rail has been laid, the vulcanized rubber pad is irreversibly deformed, especially in the region of the longitudinal strips and, when a train passes, it has a limited elasticity and therefore limited damping capacity. Another drawback of the known rail pads is associated with the poor recyclability of the vulcanized rubber, which increases the costs for maintenance of the railway network. Also during production, manufacturing of the vulcanized rubber requires a considerable amount of power.

All these factors make the large-scale use of vulcanized rubber pads disadvantageous in economic terms and ecologically unsustainable, especially considering the extent of the railway network and therefore the large number of pads which must be used to cover all the sleepers.

The technical problem at the base of the present invention is that of devising a rubber pad for rails which is able to facilitate laying of the rail, reducing the friction between the rail and the pad, improve the damping action between rail and sleeper when a train passes, thus improving the travelling comfort and reducing the stresses acting on the sleeper and the rail, and at the same time reducing the environmental impact and the cost of the installation of new railway sections or maintenance of existing sections, thus overcoming all the drawbacks which are currently associated with the known rail pads.

SUMMARY OF THE INVENTION

The technical problem described above is solved by a rubber pad according to this disclosure.

Particularly advantageous embodiments of the pad according to the present invention are specified in the dependent claims.

Further features and advantages of the rubber pad according to the present invention are described below by way of a non-limiting example given with reference to the accompanying drawings.

DETAILED DESCRIPTION

Figure 1:
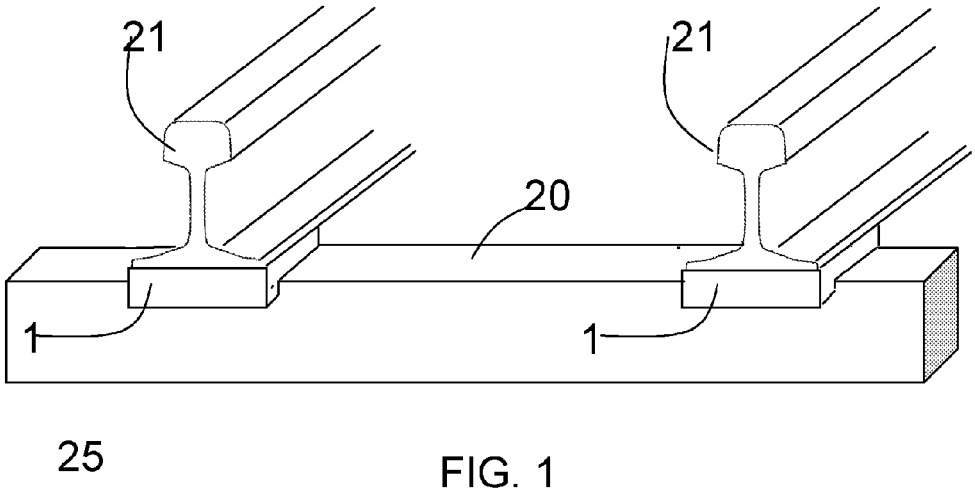
FIG. 1 shows a partial perspective view of a pad according to the present invention, arranged between a sleeper of a track and a rail of the track.

With reference to the attached FIG. 1, a pad 1 according to the present invention is represented. The pad 1 is intended to be arranged between a rail 21 and a sleeper 20 of a track formed by a pair of parallel rails 21. Alternatively, the pad 1 may be arranged between an accessory mounted on said sleeper 20 and the rail 21.

Each rail 21 has a length of several tens of meters and is placed on top of a plurality of sleepers 20 made of wood or cement, which are positioned parallel to each other along the track at a predefined distance from each other. The sleeper also has a predefined length, substantially corresponding to the width of the track, and a predefined width, indicated by L1 in the figure.

The rubber pad 1 comprises a flat portion 2 with a width L1 substantially the same as the width L1 of the sleeper 20.

Figure 2:
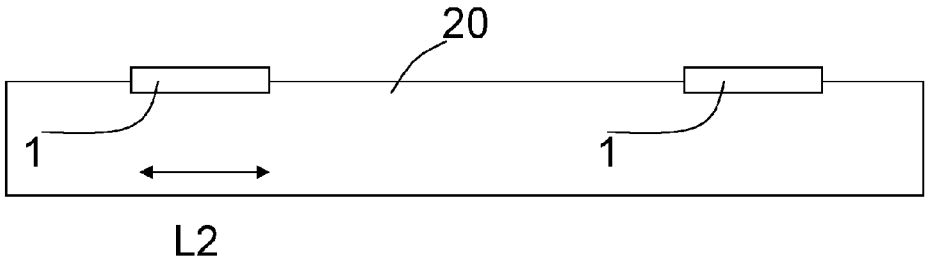
FIG. 2 shows a cross-sectional view of the pad and the track, according to FIG. 1.

The length L2 of the pad 1 is substantially the same as that of the base of the rail or a width L2 of the rail (FIG. 2). The pad 1 has a quadrangular shape in plan view and forms a flat rubber covering element for the sleeper. The abovementioned forms and dimensions of the pad 1 do not, however, limit the present invention.

Figure 3:
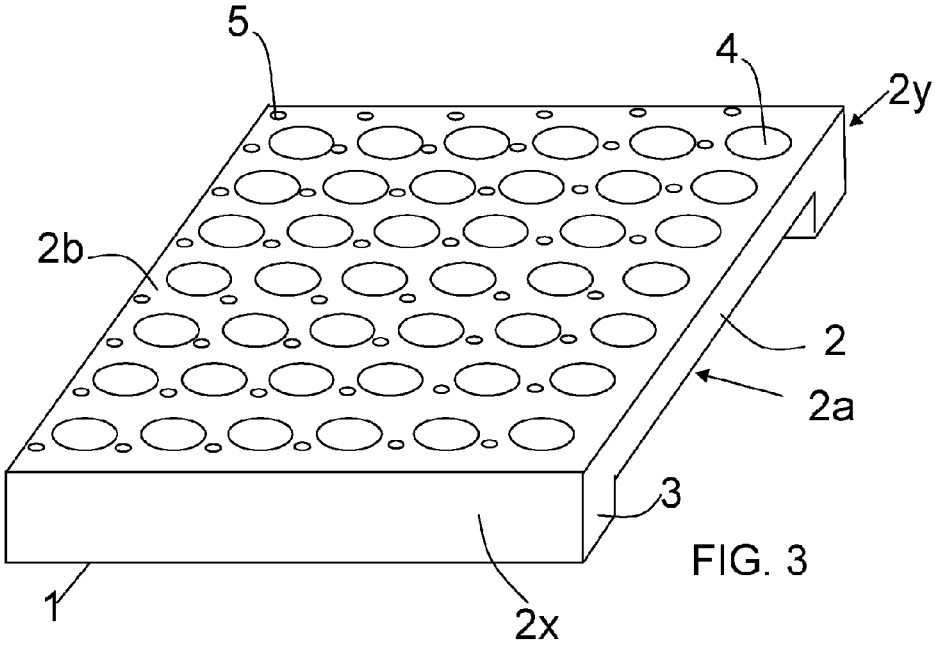
FIG. 3 shows a perspective view of the pad, according to the present invention.
Figure 4:
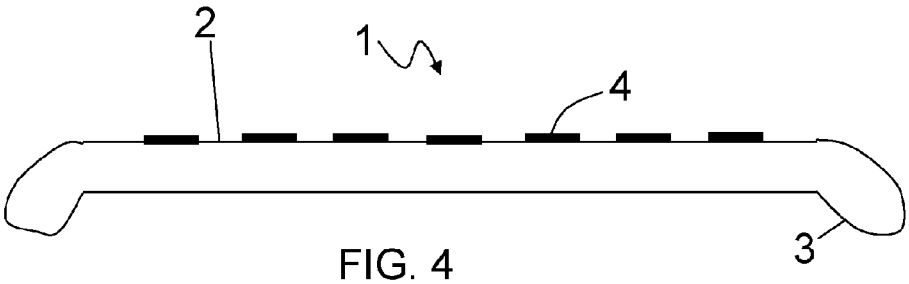
FIG. 4 shows a side view of the pad, according to FIG. 3.
Figure 5:
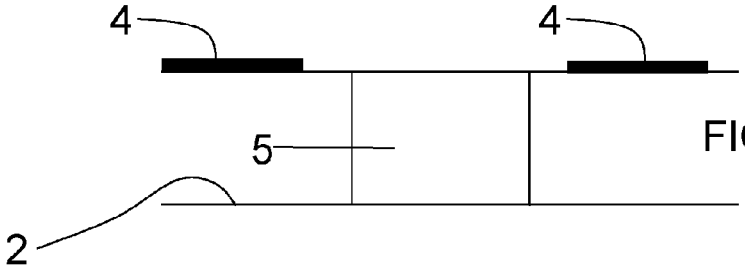
FIG. 5 shows a partial cross-sectional view of a detail of the pad, according to FIG. 3.

In particular, according to the present invention, the flat portion 2 of the pad 1 comprises a plurality of holes 5, as shown in the perspective view of FIG. 3. Each hole 5 defines a cavity in the thickness of the flat portion 2 which is intended to be closed by the rail 21 and/or by the sleeper 20, when the pad 1 is arranged between them. In particular, in one embodiment of the present invention, the holes 5 are holes which pass through the flat portion 2, as shown in FIG. 5. The through-holes 5 are intended to be closed by the sleeper 20, along the surface 2*a* of the flat portion 2, and by the rail 21, along the opposite surface 2*b*, thus hermetically enclosing several air pockets inside the flat portion 2.

These pockets act as damping devices between the sleeper 20 and the rail 21 when a train passes over them. In particular, when there is a passing train, each hole 5 defined in the flat portion 2 is subject to an elastic deformation, caused by the pressure of the weight of the train on the pad 1, which compresses the air inside the hole 5 by means of the rail 21. Once the train has passed by, the hole 5 reassumes its original configuration owing to the elastic recall action of the rubber material forming the pad 1.

According to one aspect of the invention, in the thickness of the pad, parallel to its surface 2*b*, a membrane is incorporated which divides each of the holes 5 into a respective top hole 5*a* and bottom hole 5*b*. The membrane is elastic, preferably comprises a plurality of holes 4 and cushions the air flow from the bottom hole 5*b* to the top hole 5*a*, and vice versa, therefore further improving damping of the pad 1, when a train passes over it, and reducing the vibrations.

Figure 12:
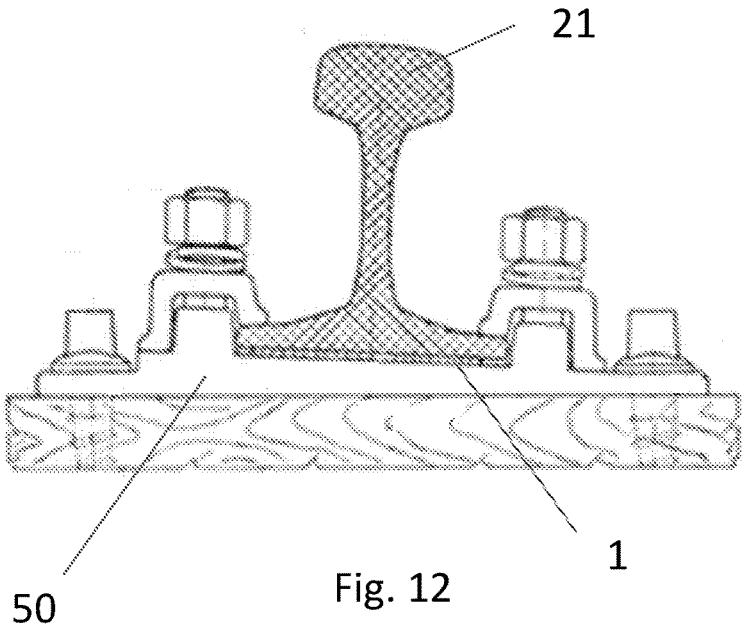
FIGS. 12 and 13 are front views of a rail and the associated sleeper, between which a pad according to the present invention is installed.

Preferably, the membrane is electrically insulating and insulates the top part of the pad from the bottom part, preventing electric current from passing between the rail 21 and a metal plate 50 supporting the pad 1 on the sleeper 20 (FIG. 12).

In this connection, preferably, the pad 1 is made of thermoplastic rubber or a thermoplastic rubber mixture.

Advantageously, for producing the thermoplastic rubber pad, a much smaller amount of energy is required compared to the energy required for the production of a vulcanized rubber pad of the known type and results not only in less pollution associated with the production but also in a reduction in the production cost of the pad.

Furthermore, disposal of thermoplastic rubber pads is much more convenient than disposal of vulcanized rubber pads since the thermoplastic rubber is much easier to recycle and much less invasive from the environmental point of view.

According to an embodiment of the present invention, the holes 5 are formed in a predefined thickness of the flat portion 2 and define a cavity with an opening only on the surface 2*b* intended to come into contact with the rail 21 or a cavity with an opening only on the surface 2*a* intended to come into contact with the sleeper 20.

Alternatively, the holes define opposite cavities having openings on both surfaces 2*a* and 2*b*. The cavities are intended to be closed after positioning the pad 1, i.e. as a result of positioning of the rubber pad 1 between the sleeper 20 and the rail 21, and act as damping air pockets, as already described above.

Figure 6:
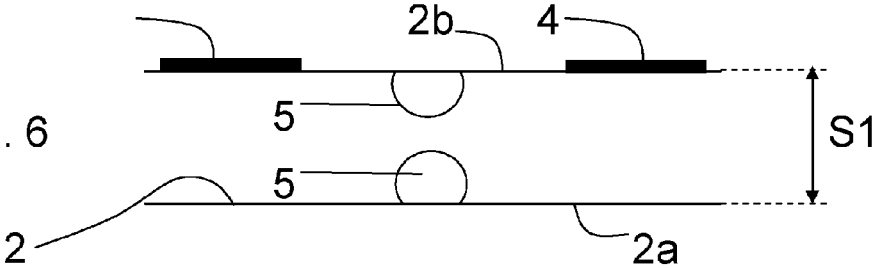
FIG. 6 is a partial cross-sectional view of a detail of the pad shown in FIG. 3, according to an embodiment of the invention.
Figure 7:
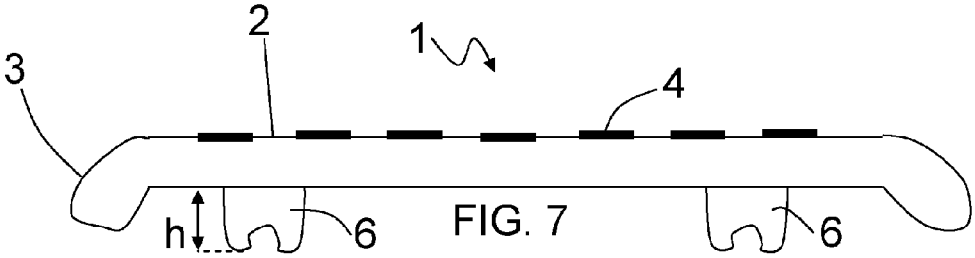
FIG. 7 is a side view of the pad according to another embodiment of the present invention.

FIG. 6 shows in schematic form a detail of the rubber pad 1 according to an embodiment where two opposite cavities are defined in the thickness of the flat portion and open out on the opposite surfaces of the flat portion 2.

According to another aspect of the invention, at least the surface 2*b* of the flat portion 2 intended to come into contact with the rail 21 comprises a plurality of reliefs 4 which are intended to reduce a surface area along which the rail 21 is in contact with the pad, during laying on the sleeper 20. During these laying operations, the rail 21 is at least partially raised from the pad 1 and the reliefs 4 advantageously facilitate sliding of the rail 21 and small displacements thereof, laterally with respect to the sleeper 20 or in the direction of the track, in order to determine a correct laying position of the rail 21.

In one embodiment, several reliefs 4, having a thickness much smaller than the thickness of the pad, for example a thickness of 1 mm, are formed on the surface 2*b* and form an array of reliefs 4. Such an arrangement allows a reduction in the friction during laying of the rail 21 substantially in every point of the pad 1.

The arrangement of the holes 5 may also consist of an array, as shown in FIG. 3, thus forming an array of holes in the pad. Preferably, the holes 5 are positioned around the reliefs 4, for example four holes 5 are arranged around each relief 4. Such an arrangement improves the damping effect along the whole length of the pad 1.

The Applicant has also noticed that an improved damping action is obtained by means of the formation of roughness on the top and bottom surfaces of the pad which is suitably adapted in each case to the rail and the sleeper or the support plate on the sleeper. In particular, the roughness on the surface facing the rail may be different from the roughness on the opposite surface of the pad, which may be for example chosen depending on the surface with which it is intended to make contact, for example the cement or wood of a sleeper or the metal of a plate 50.

According to another aspect of the invention, the pad 1 has two shoulders 3 intended to rest on one flank 25 of the sleeper 20. One shoulder 3 is on one side 2*x* of the pad 1 and the other shoulder 3 is on the opposite side 2*y*; after laying, the flat portion 2 (surface 2*a*) of the pad 1 remains in contact with the top surface of the sleeper 20.

Figure 8:
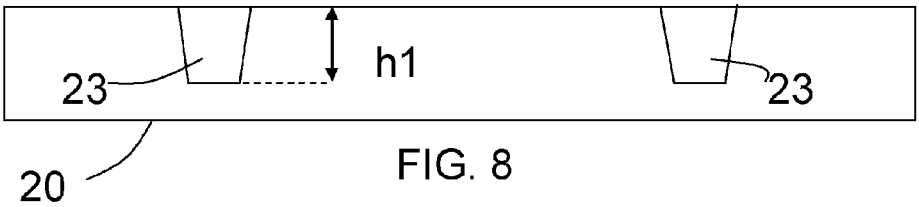
FIG. 8 is a side view of a sleeper on which the pad according to FIG. 7 is intended to be fixed.

According to a further aspect of the present invention, the pad 1 also comprises means for performing quick engagement with the sleeper 20 which, as shown in FIG. 8, may be provided with one or more seats 23 for engaging the pad 1. The engagement means comprises projections 6, which preferably project from the surface 2*a* of the pad by an amount h greater than a height h1 (or depth) of the engaging seats 23 in the sleeper 20. Such a configuration of the projections 6 further improves the damping action of the pad 1 between the rail 21 and the sleeper 20, also during laying of the rail 21.

The pad according to the present invention may be subject to various modifications, all of which are within the scope of protection of the invention.

Figure 14:
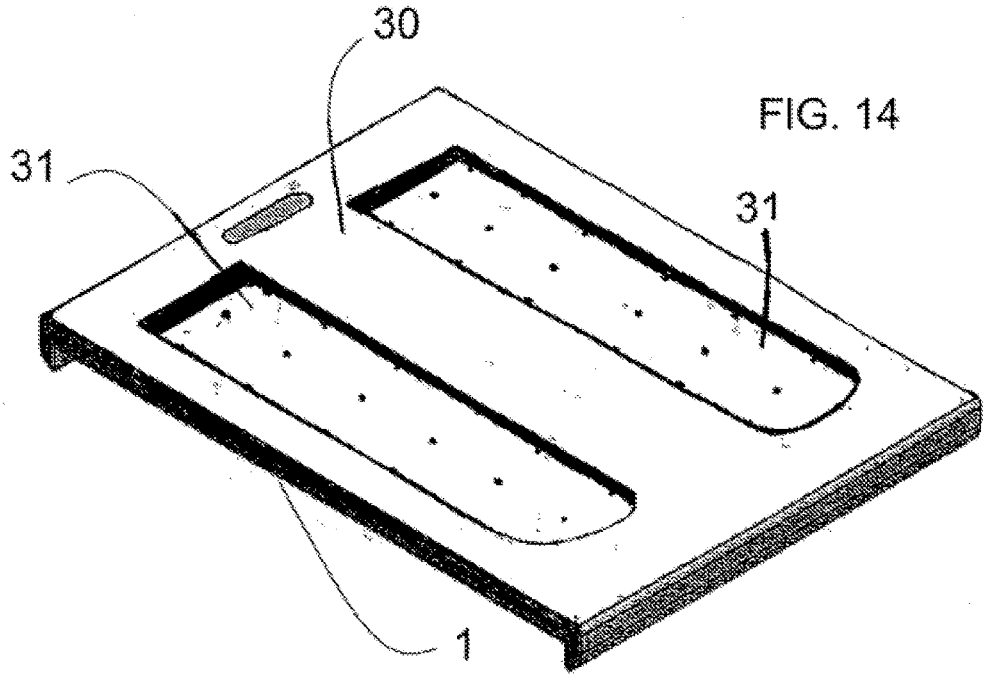
FIG. 14 shows a perspective view of the pad according to FIG. 10.

In particular, a plastic lining 30 may be provided so as to cover at least a surface portion of the pad 1 intended to face the rail 21 during use. For example, a lining such as that shown in FIG. 14 defines two windows 31 for accessing the holes 5 in the pad.

According to an embodiment, the pad 1 forms essentially an insert 1 inside the plastic lining 30.

Advantageously it is envisaged that the insert 1 (pad) and its lining may be made of different materials. For example, the lining 30 may be more flexible and elastically deformable than the insert 1, in order to assist more the deformations of the rail 21 due, for example, to fluctuations in temperature, while the rubber insert 1 (pad) may be more rigid, in order to keep the configuration of the air pockets 5 substantially unchanged, this configuration being designed precisely in order to optimize the damping function of the pad 1 between sleeper 20 and rail 21.

In other words, the pad 1 is an insert free or floating inside its plastic lining 30 and does not assume the deformations of the lining 30 during use. Advantageously, according to this aspect of the invention, also following ample deformation of the lining 30, the air volume inside the pockets of the pad 1 remain substantially unchanged and therefore allows the pad to perform the same damping action which it would have performed without deformations.

Figure 10:
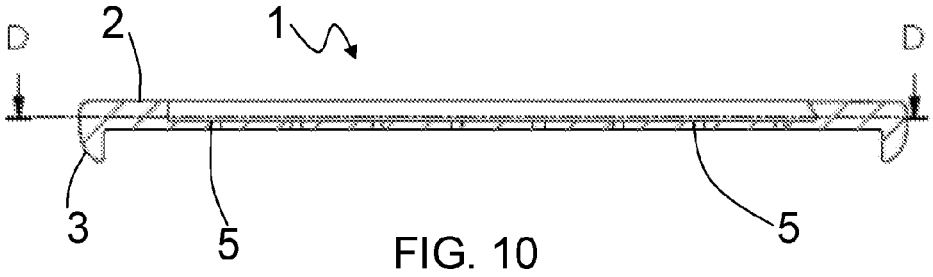
FIG. 10 shows a cross-sectional view along the line A-A of the pad according to FIG. 9.
Figure 9:
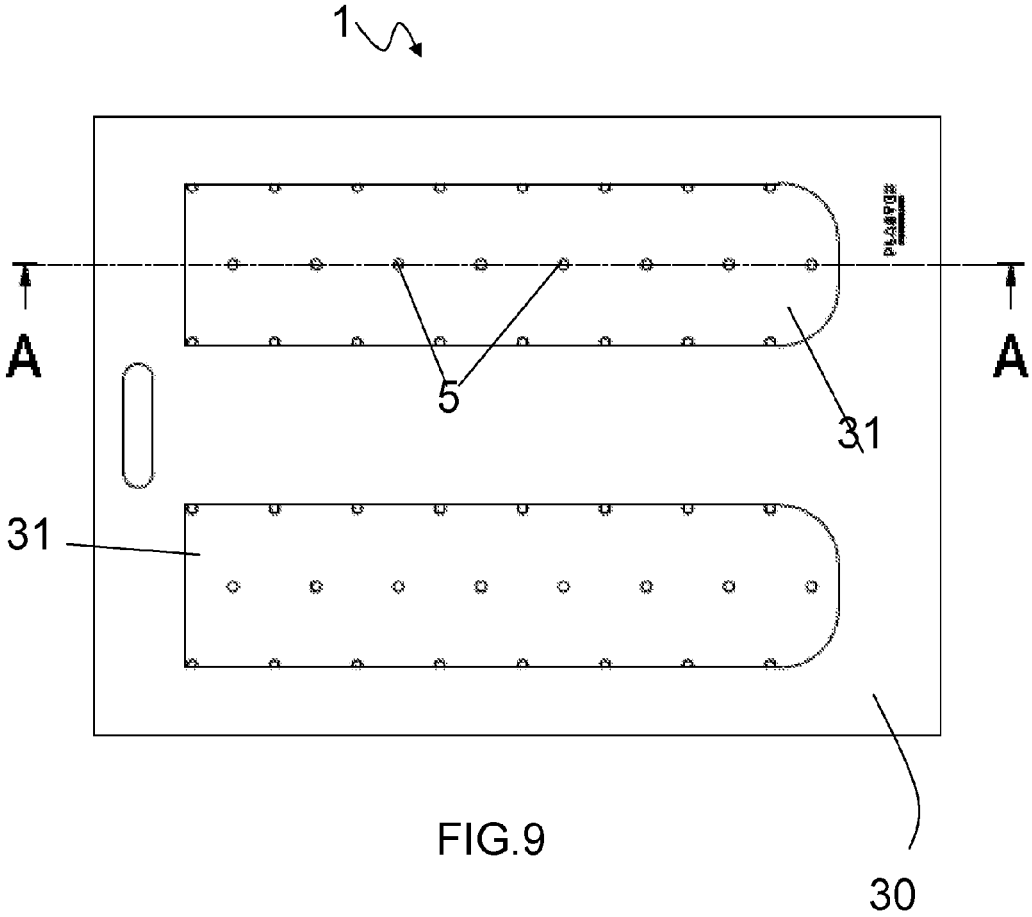
FIG. 9 is a top plan view of the pad according to another variation of embodiment of the present invention.
Figure 11:
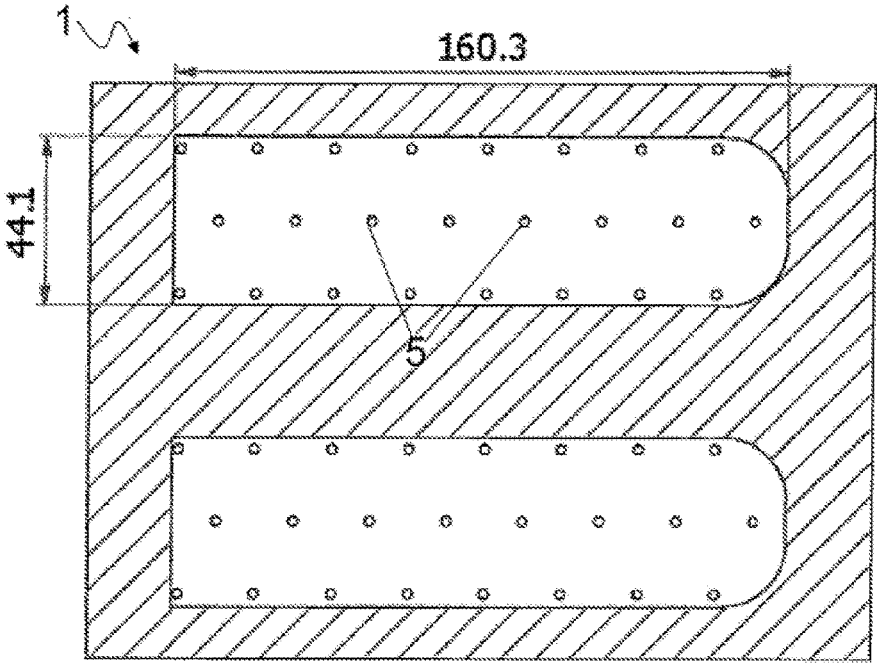
FIG. 11 shows a cross-sectional view along the line D-D of the pad according to FIG. 10.

FIG. 9 shows a top plan view of the pad, where it is possible to see two windows 31 for accessing the holes 5 in the pad 1 and the plastic lining 30. FIG. 10 shows a cross-section of the pad according to FIG. 9 in which the ratio between a thickness of the pad in the region of the windows 31 and an overall thickness of the pad in the region of the lining 30 may be appreciated, said ratio being preferably equal to about 0.5. FIG. 12 shows a longitudinal section, along a plane D-D above the holes 5.

Figure 15:
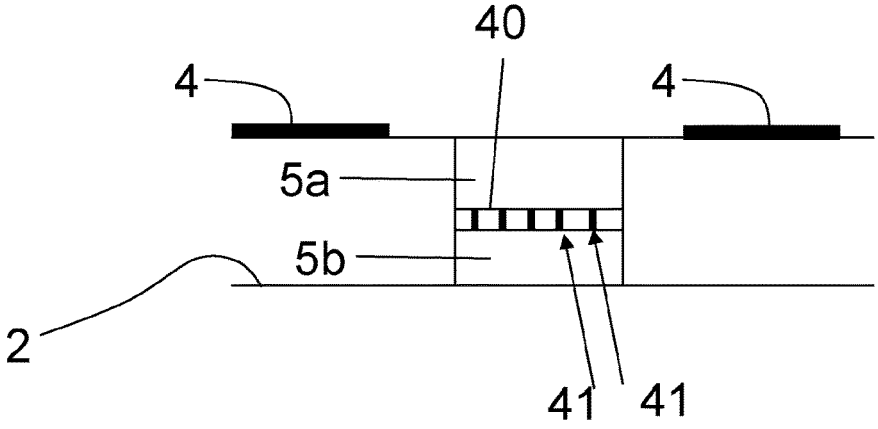
FIG. 15 is a partial cross-sectional view of a detail of the pad, according to another embodiment of the present invention.

According to another embodiment of the invention, which may be seen for example with reference to FIG. 15, the rubber pad 1 comprises an elastic membrane 40 which separates off top holes 5*a* and bottom holes 5*b* inside each hole 5.

The membrane is situated in the thickness of the pad 1 and, for example, separates off two layers of the same thickness in the pad 1. During use, and in particular when a train is passing, the rail compresses the pad 1 together with the air inside the top hole or pocket 5*a*, with the effect of deforming the membrane 40 downwards. The air present inside the bottom hole or pocket 5*b* offers resistance to the deformation of the membrane and helps dampen the weight of the train on the sleeper.

Preferably, the elastic membrane 40 comprises a plurality of micro-holes 41 which allow an air flow from the top holes 5*a* to the bottom holes 5*b*, during compression, i.e. when a train passes over them, and a discharging flow in the opposite direction, i.e. after the train has passed by.

Figure 13:
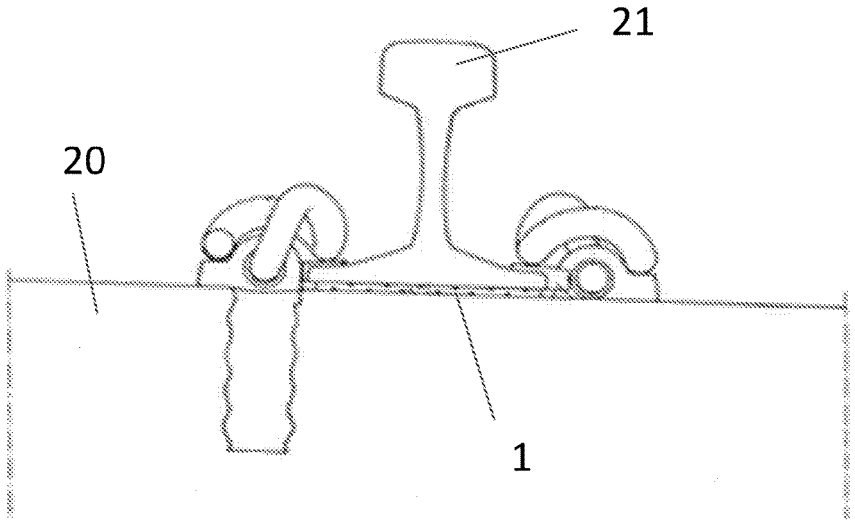

Even more preferably, the elastic membrane is electrically insulating and prevents electric current from passing from the rail to the sleeper and vice versa. This configuration of the membrane is particularly useful in the case where the pad is not in direct contact with a sleeper 20 made of cement or wood, but with a metallic plate 50 positioned on the sleeper, as shown in FIG. 12. Such mounting of the pad on the sleeper is described as being "indirect" since it is performed via the metal plate 50. Obviously it is also entirely possible for the same configuration of the pad 1 to be used also in a so-called "direct" mounting arrangement, i.e. where the pad 1 rests directly on the sleeper 20, as shown in FIG. 13.

The invention claimed is:

1. A rubber pad intended to be arranged between a sleeper of a track or an accessory mounted on said sleeper and a rail of said track, said rubber pad comprising:

a flat portion having a width substantially the same as a width of the sleeper, wherein the flat portion includes a plurality of holes, the plurality of holes including top holes and bottom holes;

a plastic lining that covers at least a surface portion of the rubber pad, the plastic lining being configured to face the rail during use; and an elastic membrane positioned in the rubber pad, the elastic membrane separating the top holes of the plurality of holes from the bottom holes of the plurality of holes.

2. The rubber pad according to claim 1, wherein the top holes are aligned with the bottom holes.

3. The rubber pad according to claim 1, wherein the plurality of holes are defined in a predetermined thickness of the flat portion, which is smaller than a thickness of the flat portion.

4. The rubber pad according to claim 1, further comprising:

two shoulders on opposite sides of the flat portion and along a whole length of the flat portion;

wherein said rubber pad is intended to remain with the flat portion on the sleeper and the two shoulders on opposite sides of a flank of the sleeper.

5. The rubber pad according to claim 1, wherein the flat portion is made of thermoplastic rubber.

6. The rubber pad according to claim 1, further comprising a plurality of reliefs on a surface of the flat portion intended to remain in contact with the rail.

7. The rubber pad according to claim 6, wherein the plurality of reliefs are circular or arranged in an array on the surface.

8. The rubber pad according to claim 6, wherein each relief of the plurality of reliefs is associated with or surrounded by a predetermined number of holes of the plurality of holes.

9. The rubber pad according to claim 6, wherein each relief of the plurality of reliefs is surrounded by only four holes of the plurality of holes.

10. The rubber pad according to claim 8, wherein the predetermined number of holes are arranged in an array.

11. The rubber pad according to claim 1, wherein the flat portion includes a surface intended to remain in contact with the sleeper, the surface including at least one projection that can be inserted inside a corresponding hole of the sleeper.

12. The rubber pad according to claim 1, wherein the plastic lining defines two windows for accessing the plurality of holes in the rubber pad.

13. The rubber pad according to claim 1, wherein the elastic membrane is electrically insulating.

14. The rubber pad according to claim 1, wherein the elastic membrane includes a plurality of micro-holes.

* * * * *